US006920945B1

(12) United States Patent
Belew et al.

(10) Patent No.: US 6,920,945 B1
(45) Date of Patent: Jul. 26, 2005

(54) METHOD AND SYSTEM FOR FACILITATING HORIZONTAL DRILLING

(75) Inventors: David A. Belew, Midland, TX (US); Barry Belew, Odesaa, TX (US)

(73) Assignee: Lateral Technologies International, L.L.C., Midland, TX (US)

( * ) Notice: Subject to any disclaimer, the term of this patent is extended or adjusted under 35 U.S.C. 154(b) by 20 days.

(21) Appl. No.: 10/290,113

(22) Filed: Nov. 7, 2002

Related U.S. Application Data

(60) Provisional application No. 60/348,476, filed on Nov. 7, 2001.

(51) Int. Cl.[7] ..... E21B 7/08; E21B 7/18; E21B 43/114; E21B 29/06

(52) U.S. Cl. ..... 175/67; 166/55.2; 166/298; 175/75; 175/320; 175/424

(58) Field of Search ..... 166/297, 298, 166/55, 55.1, 55.2; 175/424, 62, 65, 67, 75, 175/172, 320

(56) References Cited

U.S. PATENT DOCUMENTS

| | | | | | |
|---|---|---|---|---|---|
| 1,367,042 | A * | 2/1921 | Bernard | 175/45 |
| 2,198,016 | A * | 4/1940 | Rogers et al. | 175/82 |
| 2,258,001 | A * | 10/1941 | Chamberlain | 175/40 |
| 2,271,005 | A * | 1/1942 | Grebe | 175/61 |
| 2,642,267 | A * | 6/1953 | Zublin | 175/75 |
| 2,687,282 | A * | 8/1954 | Sanders | 175/263 |
| 2,708,099 | A * | 5/1955 | Zublin | 175/75 |
| 3,191,697 | A * | 6/1965 | Haines | 175/81 |
| 3,640,344 | A * | 2/1972 | Brandon | 166/249 |
| 3,958,649 | A * | 5/1976 | Bull et al. | 175/61 |
| 4,007,797 | A * | 2/1977 | Jeter | 175/26 |
| 4,062,196 | A * | 12/1977 | Yoshida et al. | 405/184 |
| 4,168,752 | A * | 9/1979 | Sabol | 175/12 |
| 4,328,839 | A * | 5/1982 | Lyons et al. | 138/120 |
| 4,368,786 | A * | 1/1983 | Cousins | 175/78 |
| 5,333,699 | A * | 8/1994 | Thigpen et al. | 175/431 |
| 5,413,184 | A * | 5/1995 | Landers | 175/62 |
| 5,538,092 | A * | 7/1996 | Precopia | 175/74 |
| 5,601,151 | A * | 2/1997 | Warren | 175/75 |
| 5,853,056 | A * | 12/1998 | Landers | 175/424 |
| 5,944,123 | A * | 8/1999 | Johnson | 175/73 |
| 6,257,353 | B1 * | 7/2001 | Belew et al. | 175/2 |
| 6,523,624 | B1 * | 2/2003 | Cousins et al. | 175/386 |
| 6,588,517 | B2 * | 7/2003 | Baird | 175/75 |
| 2002/0108787 | A1 * | 8/2002 | Baird | 175/78 |
| 2002/0134586 | A1 * | 9/2002 | Baird | 175/45 |

* cited by examiner

*Primary Examiner*—David Bagnell
*Assistant Examiner*—Jennifer H Gay
(74) *Attorney, Agent, or Firm*—Jack D. Stone, Jr.

(57) ABSTRACT

A method for facilitating horizontal drilling by positioning in a well casing a shoe defining a passageway extending from an upper opening in the shoe through the shoe to a side opening in the shoe. A rod is connected, through at least one block and pin assembly operative as a universal joint, to a casing mill end, and inserted into the well casing and through the passageway in the shoe until the casing mill end substantially abuts the well casing. The rod and casing mill end are then rotated until the casing mill end substantially forms a perforation in the well casing. The rod and casing mill end are then withdrawn from the well casing, and a nozzle attached to the end of a flexible hose is extended through the passageway to the perforation. Fluid is then ejected from the nozzle and impinges and erodes subterranean formation material.

17 Claims, 3 Drawing Sheets

METHOD AND SYSTEM FOR FACILITATING HORIZONTAL DRILLING

CLAIM OF PRIORITY

This application claims priority from U.S. Provisional Patent Application No. 60/348,476 entitled "METHOD AND SYSTEM FOR FACILITATING HORIZONTAL DRILLING" filed on behalf of Belew, et al, on Nov. 7, 2001.

TECHNICAL FIELD

The present invention relates generally to a method and system for facilitating horizontal drilling into a subterranean formation surrounding a well casing.

BACKGROUND

The rate at which hydrocarbons are produced from wellbores in subterranean formations is often limited by wellbore damage caused by drilling, cementing, stimulating, and producing. As a result, the hydrocarbon drainage area of wellbores is often limited, and hydrocarbon reserves become uneconomical to produce sooner than they would have otherwise, and are therefore not fully recovered. Similarly, increased power is required to inject fluids, such as water and $CO_2$, and to dispose of waste materials, into wellbores when a wellbore is damaged.

Accordingly, there is a need for methods and systems by which wellbore damage may be minimized and/or bypassed, so that hydrocarbon drainage areas and drainage rates may be increased, and the power required to inject fluids and dispose of waste materials into wellbores may be reduced.

BRIEF SUMMARY OF THE INVENTION

According to the present invention, lateral (i.e., horizontal) wellbores are utilized to facilitate a more efficient sweep in secondary and tertiary hydrocarbon recovery fields, and to reduce the power required to inject fluids and dispose of waste materials into wells. The horizontal drilling of such lateral wellbores through a well casing is facilitated by positioning in the well casing a shoe defining a passageway extending from an upper opening in the shoe through the shoe to a side opening in the shoe. A rod and casing mill assembly is then inserted into the well casing and through the passageway in the shoe until a casing mill end of the casing mill assembly abuts the well casing. The rod and casing mill assembly are then rotated until the casing mill end forms a perforation in the well casing.

In one aspect of the invention, the casing mill assembly comprises at least one block and pin assembly operative as a universal joint connecting the rod to the casing mill end of the casing mill assembly for facilitating the insertion of the casing mill assembly into and through the passageway of the shoe.

In yet another aspect of the invention, a nozzle attached to the end of a flexible hose is extended through the passageway to the perforation, and a fluid is ejected from the nozzle through the perforation.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
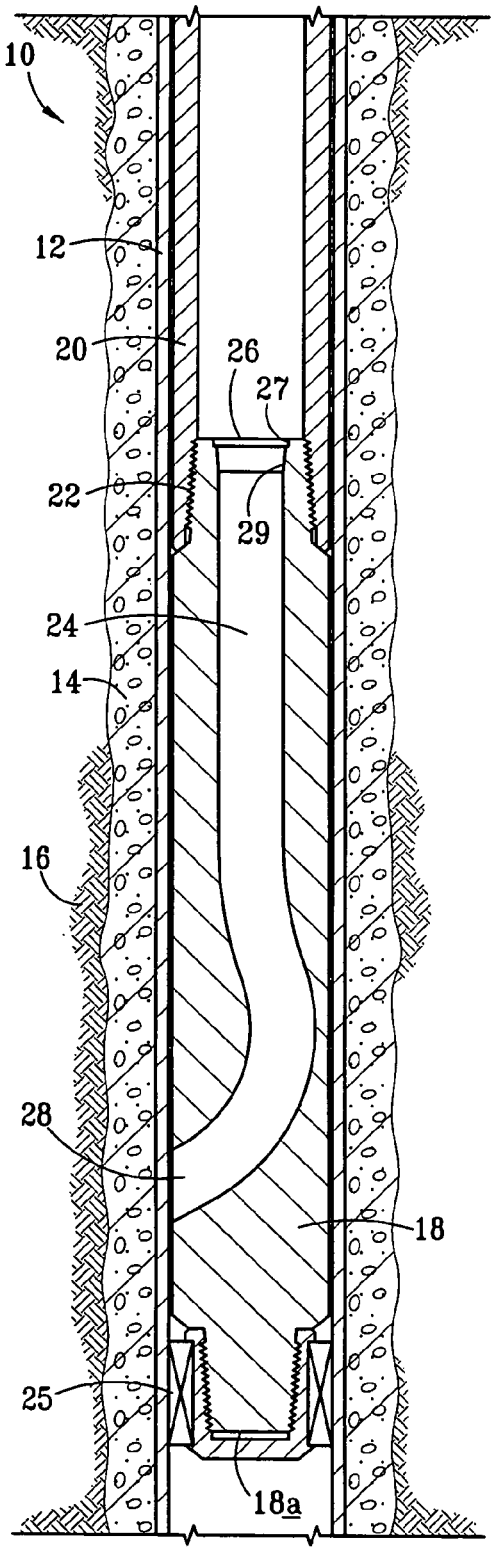
FIG. 1 is a cross-sectional elevation view of a well having a drilling shoe positioned therein.

In the discussion of the FIGURES the same reference numerals will be used throughout to refer to the same or similar components. In the interest of conciseness, various other components known to the art, such as wellheads, drilling components, motors, and the like necessary for the operation of the wells, have not been shown or discussed except insofar as necessary to describe the present invention.

Referring to FIG. 1 of the drawings, the reference numeral 10 generally designates an existing well 10 encased by a well casing 12 and cement 14. The well 10 passes through a subterranean formation 16 from which petroleum is drawn. A drilling shoe 18 is securely attached to a tubing 20 via a tapered threaded fitting 22 formed between the tubing 20 and the shoe 18. The shoe 18 and tubing 20 are defined by an outside diameter approximately equal to the inside diameter of the well casing 12 less sufficient margin to preclude jamming of the shoe 18 and tubing 20 as they are lowered through the casing 12. The shoe 18 further defines a passageway 24 which extends longitudinally through the shoe, and which includes an upper opening 26 and a lower opening 28. The upper opening 26 includes a limit chamfer 27 and a angle guide chamfer 29, for receiving a casing mill, described below.

As shown in FIG. 1, the shoe 18 is lowered in the well 10 to a depth suitable for tapping into a hydrocarbon deposit (not shown), and is angularly oriented in the well 10 using well-known techniques so that the opening 28 of the shoe 18 is directed toward the hydrocarbon deposit. The shoe 18 is fixed in place by an anchoring device 25, such as a conventional packer positioned proximate to a lower end 18*a* of the show 18. While the anchoring device 25 is shown in FIG. 1 as positioned proximate to the lower end 18*a* of the show 18, the anchoring device may be positioned above or below the shoe.

Figure 2:
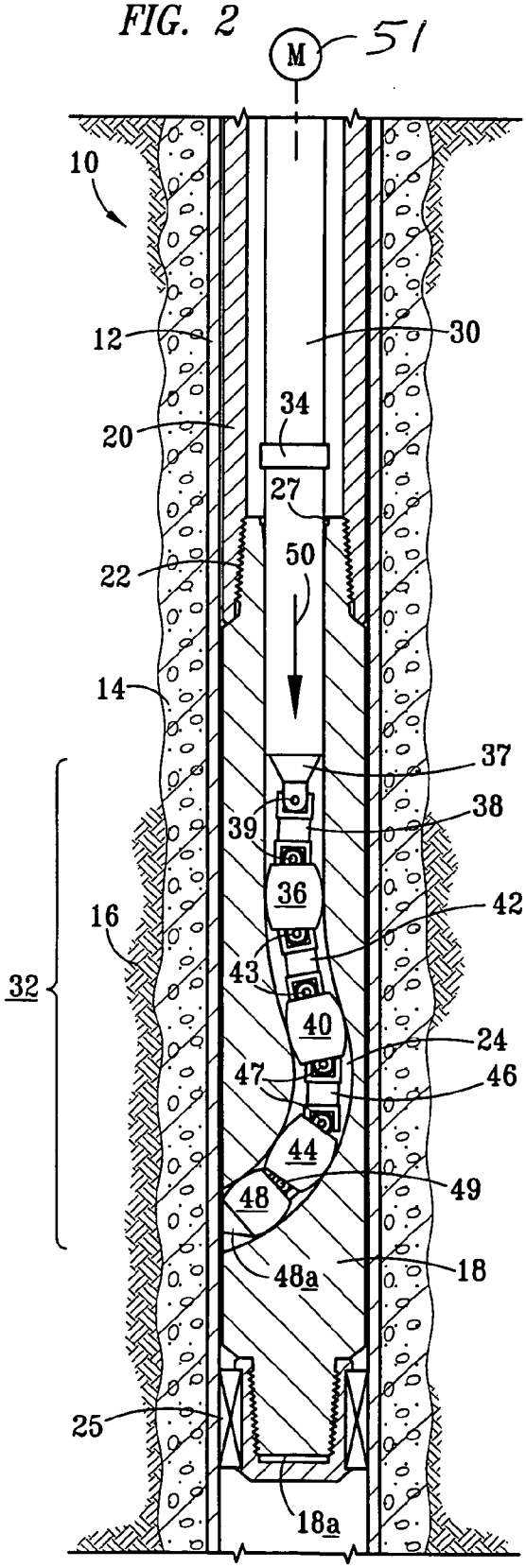
FIG. 2 is a cross-sectional elevation view of the well of FIG. 1 having a perforation mechanism embodying features of the present invention positioned within the drilling shoe.

FIG. 2 depicts the insertion of a rod 30 and casing mill assembly 32 as a single unit through the tubing 20 and into the passageway 24 of the shoe 18 for perforation of the well casing 12. The rod 30 includes an annular collar 34 sized and positioned for seating in the chamfer 27 upon entry of the casing mill 32 in the cement 14, as described below with respect to FIG. 3. The casing mill assembly 32 preferably includes, threadingly connected at the lower end of the assembly 32, a yoke adapter 37 connected to a substantially barrel-shaped (e.g., semi-spherical or semi-elliptical) yoke 36 via a substantially straight yoke 38 and two conventional block and pin assemblies 39 operative as universal joints. The barrel-shaped yoke 36 is connected to a substantially barrel-shaped yoke 40 via a substantially straight yoke 42 and two conventional block and pin assemblies 43 operative as universal joints. The barrel-shaped yoke 40 is connected to a substantially barrel-shaped yoke 44 via a substantially straight yoke 46 and two conventional block and pin assemblies 47 operative as universal joints. The barrel-shaped yoke 44 is connected to a substantially barrel-shaped yoke 48 via a conventional block and pin assembly 49 operative as a universal joint. The surfaces of the yokes 36, 40, 44, and 48 are preferably barrel-shaped so that they may be axially rotated as they are passed through the passageway 24 of the shoe 18. The yoke 48 includes a casing mill end 48*a* preferably having, for example, a single large triangular-shaped cutting tooth (shown in FIG. 2), a plurality of cutting teeth, or the like, effective upon axial rotation for milling through the well casing 12 and into the cement 14. The milling end 48*a* is preferably fabricated from a hardened, high strength, stainless steel, such as 17-4 stainless steel with tungsten carbides inserts, tungsten carbide, or the like, having a relatively high tensile strength of, for example, at least 100,000 pounds per square inch, and, preferably, at least 150,000 pounds per square inch. While three substantially barrel-shaped yokes 36, 40, and 44, and three substantially straight yokes 38, 42, 46, are shown and described with respect to FIG. 2, more or fewer yokes may be used to constitute the casing mill assembly 32.

The rod 30 is preferably connected at the well-head of the well 10 to a rotating device, such as a motor 51, effective for generating and transmitting torque to the rod 30 to thereby impart rotation to the rod. The torque transmitted to the rod 30 is, by way of example, from about 25 to about 1000 foot-pounds of torque and, typically, from about 100 to about 500 foot-pounds of torque and is, preferably, about 200 to about 400 foot-pounds of torque. The casing mill assembly 32 is preferably effective for transmitting the torque and rotation from the rod 30 through the passageway 24 to the casing mill end 48.

In operation, the tubing 20 and shoe 18 are lowered into the well casing 12 and secured in position as described above. The rod 30 and casing mill assembly 32 are then preferably lowered as a single unit through the tubing 20 and guided via the guide chamfer 29 into the shoe 18. The motor 51 is then coupled at the well-head to the rod 30 for generating and transmitting preferably from about 100 to about 400 foot-pounds of torque to the rod 30, causing the rod 30 to rotate. As the rod 30 rotates, it imparts torque and rotation to and through the casing mill assembly 32 to rotate the casing mill end 48.

Figure 3:
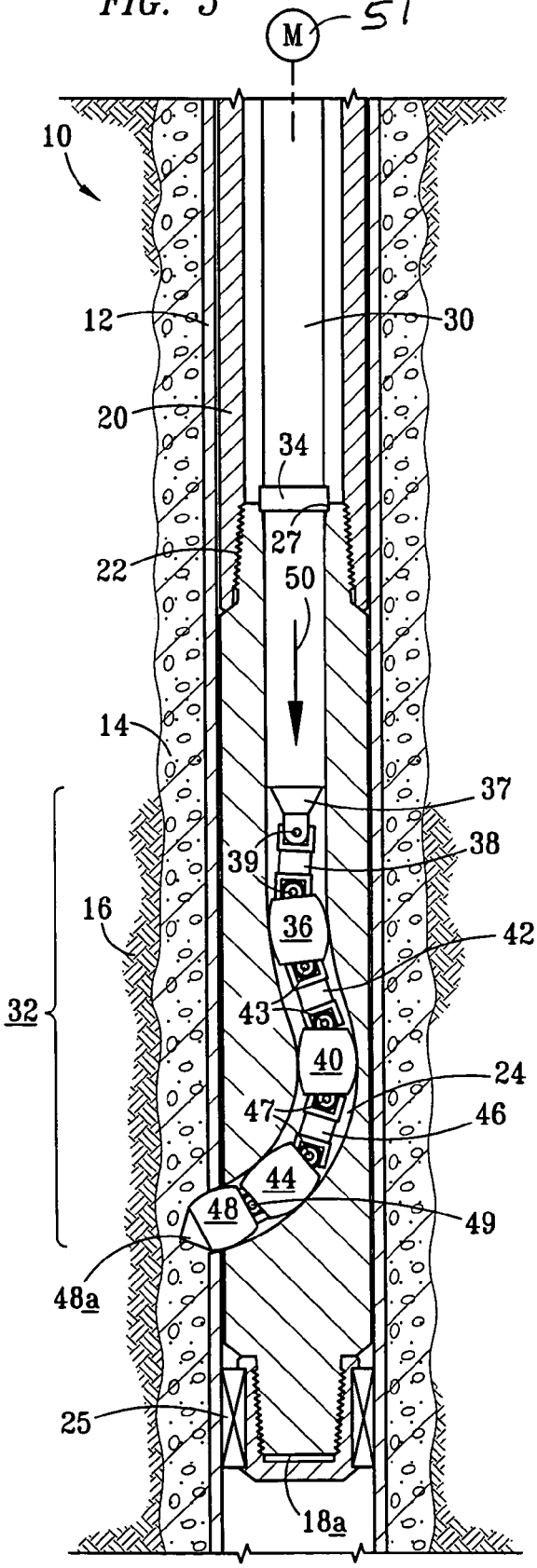
FIG. 3 is a cross-sectional elevation view of the well of FIG. 2 showing the well casing perforated by the perforation mechanism.

The weight of the rod 30 also exerts downward axial force in the direction of the arrow 50, and the axial force is transmitted through the casing mill assembly 32 to the casing mill end 48. The amount of weight transmitted through the casing mill assembly 32 to the casing mill end 48 may optionally be more carefully controlled to maintain substantially constant weight on the casing mill end 48 by using weight bars and bumper subs (not shown). As axial force is applied to move the casing mill end 48 into the well casing 12 and cement 14, and torque is applied to rotate the casing mill end 48, the well casing 12 is perforated, and the cement 14 is penetrated, as depicted in FIG. 3. The weight bars are thus suitably sized for efficiently perforating the well casing 12 and penetrating the cement 14 and, to that end, may, by way of example, be sized at 150 pounds each, it being understood that other weights may be preferably depending on the well. Weight bars and bumper subs, and the sizing thereof, are considered to be well known in the art and, therefore, will not be discussed in further detail herein.

Figure 4:
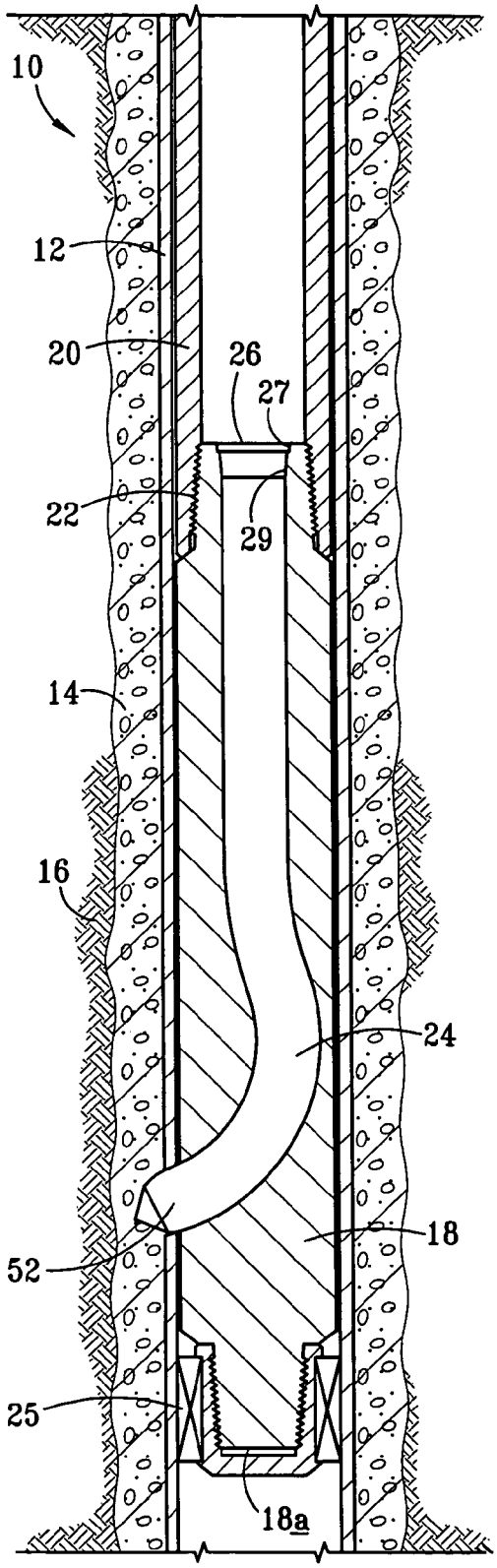
FIG. 4 is a cross-sectional elevation view of the well of FIG. 3 with the perforation mechanism removed.

As the casing mill end 48 penetrates the cement 14, the collar 34 seats in the chamfer 27, and the perforation of the well casing is terminated. The rod 30 and casing mill assembly 32 are then withdrawn from the shoe 18, leaving a perforation 52, which remains in the well casing 12, as depicted in FIG. 4. Notably, the cement 14 is preferably not completely penetrated. To obtain fluid communication with the petroleum reservoir/deposit of interest, a horizontal extension of the perforation 52 is used, as discussed below with respect to FIG. 5.

Figure 5:
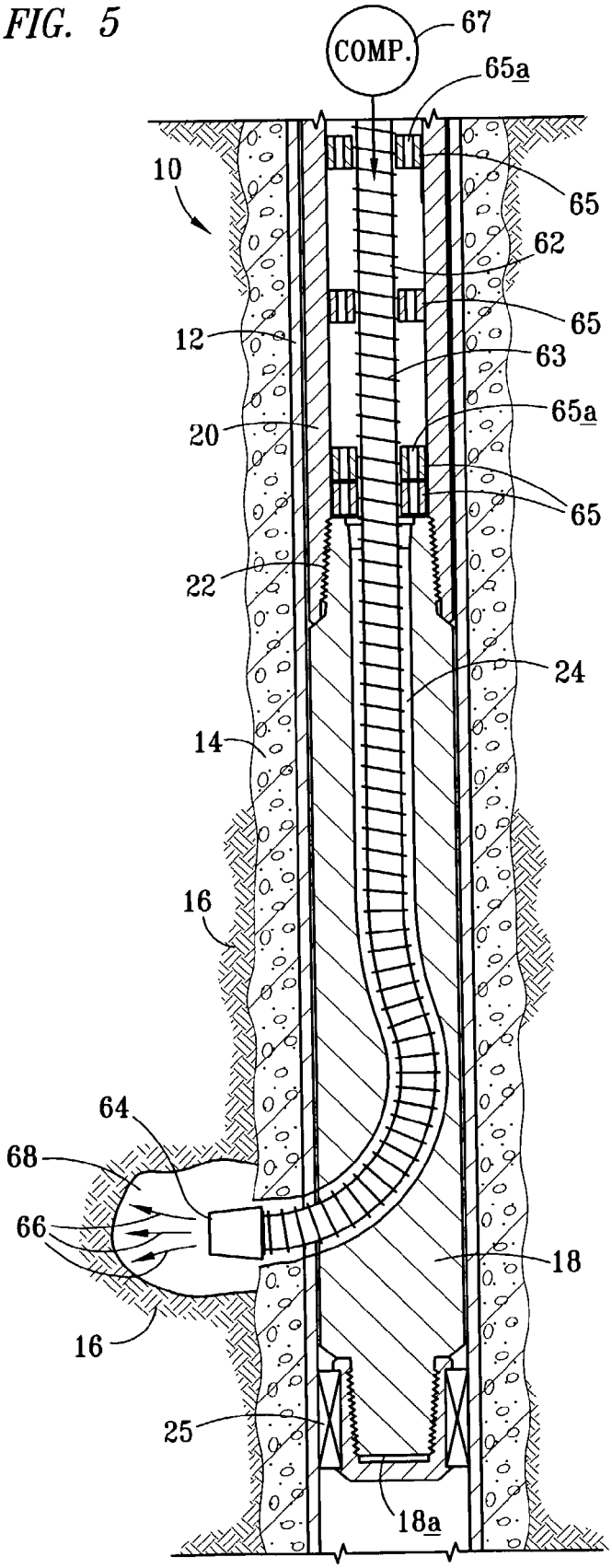
FIG. 5 is a cross-sectional elevation view of the well of FIG. 4 showing a hydraulic drilling device extended through the casing of the well.

FIG. 5 depicts a horizontal extension technique that may be implemented for extending the perforation 52 laterally into the formation 16 in accordance with present invention. The shoe 18 and tubing 20 are maintained in place. A flexible hose 62 is extended through the tubing 20, the guide chamfer 29 and passageway 24 of the shoe 18, and the perforation 52 into the cement 14. The flexible hose 62 is preferably a high-pressure flexible hose, such as a Polymide 2400 Series hose. The hose 62 is preferably circumscribed by a spring 63 preferably comprising spiral wire having a square cross-section which abuts the nozzle 64 for "pushing" the hose 62 downwardly through the tubing 20. The spring 63 may alternatively comprise spiral wire having a round cross-section. The tip of the hose 62 is preferably provided with a high-pressure nozzle 64, which is preferably a rotating nozzle, though a fixed nozzle may be utilized in relatively soft formations. A plurality of annular guides, referred to herein as centralizers, 65 are preferably positioned about the spring 63 and suitably spaced apart for inhibiting bending and kinking of the hose 62 within the tubing 20. Each centralizer 65 has a diameter that is substantially equal to or less than the inside diameter of the tubing 20, and preferably also defines a plurality of slots and/or holes 65*a* for facilitating the flow of fluid through the tubing 20. The centralizers 65 are also configured to slide along the spring 63 and rest and accumulate at the top of the shoe 18 as the hose 62 is pushed through the passageway 24 and perforation 52 into the formation 16.

Drilling fluid is then pumped at high pressure through the hose 62 to the nozzle 64 using conventional equipment 67 (e.g., a compressor, a pump, and/or the like) at the surface of the well 10. The drilling fluid used may be any of a number of different fluids effective for eroding subterranean formation, such fluids comprising liquids, solids, and/or gases including, by way of example, one or a mixture of two or more of fresh water, produced water, polymers, surfactants, carbon dioxide, methane, nitrogen, acid, and the like, which fluids may be volatile or non-volatile, compressible or non-compressible, and/or optionally may be utilized at supercritical temperatures and pressures. The drilling fluid is preferably injected through the hose 62 and ejected from the nozzle 64, as indicated schematically by the arrows 66, to impinge subterranean formation material. The drilling fluid loosens, dissolves, and erodes portions of the earth's formation 16 around the nozzle 64. The excess drilling fluid flows into and up the well casing 12 and tubing 20, and may be continually pumped away and stored. As the earth 16 is eroded away from the frontal proximity of the nozzle 64, an opening 68 is created, and the hose 62 is extended into the opening. The opening 54 may generally be extended laterally as far as about 200 feet, though it is not limited to being extended 200 feet, to insure that an opening 68 is created between the well 10 and the desired petroleum formation in the earth's formation 16.

After a sufficient opening 68 has been created, the flexible hose 62 is withdrawn upwardly from the shoe 18 and tubing 20. The tubing 20 is then pulled upwardly from the well 10 and, with it, the shoe 18. Excess drilling fluid is then pumped from well 10, after which petroleum product may be pumped from the formation.

It is understood that the present invention may take many forms and embodiments. Accordingly, several variations may be made in the foregoing without departing from the spirit or the scope of the invention. For example, the nozzle 64 may be configured for being guided in the subterranean formation 16.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A method for facilitating horizontal drilling through a well casing, the method comprising the steps of:

positioning in the well casing a shoe defining a passageway extending from an upper opening in the shoe through the shoe to a side opening in the shoe;

inserting a rod and casing mill assembly into the well casing and through the passageway in the shoe until a casing mill end of the casing mill assembly substantially abuts the well casing, said casing mill assembly comprising at least one barrel-shaped yoke interconnecting at least two block and pin assemblies coupled together to substantially form at least two universal joints coupling together the rod and the casing mill end of the casing mill assembly for facilitating the step of inserting; and rotating the rod and casing mill assembly until the casing mill end substantially forms a perforation in the well casing.

2. The method of claim 1 wherein the upper end of the shoe includes a chamfer and the rod includes a collar configured for seating in the chamfer and positioned on the rod so that the casing mill end of the casing mill assembly is substantially precluded from movement extending through cement surrounding the well casing.

3. The method of claim 1 wherein the casing mill end comprises a milling portion fabricated from stainless steel with carbide inserts.

4. The method of claim 1 further comprising the steps of:

extending a nozzle attached to the end of a flexible hose through the passageway to the perforation; and ejecting fluid from the nozzle.

5. The method of claim 1 further comprising the steps of:

extending a nozzle attached to the end of a flexible hose through the passageway to the perforation;

ejecting fluid from the nozzle; and extending the nozzle through the perforation.

6. The method of claim 1 further comprising the steps of:

extending a nozzle attached to the end of a flexible hose through the passageway to the perforation;

injecting surfactant into a fluid;

ejecting the fluid from the nozzle; and extending the nozzle through the perforation.

7. The method of claim 1 further comprising the steps of:

extending a nozzle attached to the end of a flexible hose through the passageway to the perforation;

ejecting the fluid from the nozzle so that the fluid impinges subterranean formation material; and extending the nozzle through the perforation.

8. The method of claim 1 wherein the step of positioning further comprises attaching the shoe to tubing, and lowering the shoe into the well casing using the tubing.

9. A system for facilitating horizontal drilling through a well casing, the system comprising:

a shoe positioned at a selected depth in the well casing, the shoe defining a passageway extending from an upper opening in the shoe through the shoe to a side opening in the shoe;

a rod connected to a casing mill assembly for insertion into and through the well casing and through the passageway in the shoe until a casing mill end of the casing mill assembly abuts the well casing, said casing mill assembly comprising at least one barrel-shaped yoke interconnected between at least two block and pin assemblies coupled together to substantially form at least one first universal joint connected to the rod and at least one second universal joint connected to the casing mill end of the casing mill assembly; and a motor positioned at the wellhead and coupled to the rod for rotating the rod and casing mill assembly until the casing mill end forms a perforation in the well casing.

10. The system of claim 9 wherein the upper end of the shoe includes a chamfer and the rod includes a collar configured for seating in the chamfer and positioned on the rod so that the casing mill end of the casing mill assembly is substantially permitted to enter cement surrounding the well casing but precluded from passing through cement surrounding the well casing.

11. The system of claim 9 wherein the casing mill end comprises a milling portion fabricated from stainless steel with carbide inserts.

12. The system of claim 9 further comprising a nozzle attached to the end of a flexible hose positioned in the passageway such that the nozzle is effective for receiving from the hose fluid and for ejecting through the perforation the fluid into subterranean formation material.

13. The system of claim 9 wherein the shoe is attached to tubing used to lower the shoe into the well casing.

14. A method for facilitating horizontal drilling, the method comprising the steps of:

positioning in a well casing a shoe defining a passageway extending from an upper opening in the shoe through the shoe to a side opening in the shoe;

coupling a rod through a casing mill assembly to a casing mill end, said casing mill assembly comprising at least one barrel-shaped yoke interconnecting at least two block and pin assemblies coupled together to substantially form at least two universal joints coupling together the rod and the casing mill end of the casing mill assembly;

inserting the rod connected to the casing mill end into the well casing and through the passageway in the shoe until the casing mill end substantially abuts the well casing; and rotating the rod and casing mill end until the casing mill end substantially forms a perforation in the well casing.

15. A method for facilitating horizontal drilling, the method comprising the steps of:

positioning in a well casing a shoe defining a passageway extending from an upper opening in the shoe through the shoe to a side opening in the shoe;

coupling a rod through a casing mill assembly to a casing mill end, said casing mill assembly comprising at least one barrel-shaped yoke interconnecting at least two block and pin assemblies coupled together to substantially form at least two universal joints coupling together the rod and the casing mill end of the casing mill assembly;

inserting the rod connected to the casing mill end into the well casing and through the passageway in the shoe until the casing mill end substantially abuts the well casing;

rotating the rod and casing mill end until the casing mill end substantially forms a perforation in the well casing;

withdrawing the rod and casing mill end from the well casing;

extending a nozzle attached to the end of a flexible hose through the passageway to the perforation;

ejecting carbon dioxide from the nozzle so that the carbon dioxide impinges subterranean formation material as a liquid; and extending the nozzle through the perforation.

16. A system for facilitating horizontal drilling, the system comprising:

a shoe positioned at a selected depth in a well casing of a well, the shoe defining a passageway extending from an upper opening in the shoe through the shoe to a side opening in the shoe;

a rod and a casing mill end interconnected by at least two universal joints interconnected by a barrel shaped yoke and positioned in the well casing and through the passageway in the shoe until a casing mill end of the casing mill assembly abuts the well casing; and a motor positioned at the surface of the well and coupled to the rod for rotating the rod and casing mill assembly until the casing mill end forms a perforation in the well casing.

17. A system for facilitating horizontal drilling, the system comprising:

a shoe positioned at a selected depth in a well casing of a well, the shoe defining a passageway extending from an upper opening in the shoe through the shoe to a side opening in the shoe;

a rod and a casing mill end interconnected by at least two universal joints interconnected by a barrel shaped yoke and positioned well casing and through the passageway in the shoe until a casing mill end of the casing mill assembly abuts the well casing;

a motor positioned at the wellhead of the well and coupled to the rod for rotating the rod and casing mill assembly until the casing mill end forms a perforation in the well casing; and a nozzle attached to the end of a flexible hose positioned in the passageway such that the nozzle is effective for receiving from the hose fluid, and for ejecting through the perforation the fluid into the subterranean formation.

* * * * *